United States Patent [19]

Gunn

[11] 4,094,574

[45] June 13, 1978

[54] COAXIAL CABLE CONNECTOR DEVICE AND METHOD OF MANUFACTURE THEREOF

[76] Inventor: Thomas L. Gunn, P.O. Box 246, Bonaparte, Iowa 52620

[21] Appl. No.: 754,407

[22] Filed: Dec. 27, 1976

[51] Int. Cl.[2] ..... H01R 17/06

[52] U.S. Cl. ..... 339/177 E; 339/218 R

[58] Field of Search ..... 339/177 R, 177 E, 182 R, 339/183, 218 R, 218 M, 28, 119 R

[56] References Cited

U.S. PATENT DOCUMENTS

| | | | |
|---|---|---|---|
| 2,995,718 | 8/1961 | Murphy | 339/177 R |
| 3,354,420 | 11/1967 | Mineck | 339/177 R |
| 3,372,364 | 3/1968 | O'Keefe et al. | 339/177 R |
| 3,611,271 | 10/1971 | Knapp | 339/177 E |
| 3,701,086 | 10/1972 | Somerset | 339/177 R |
| 3,781,763 | 12/1973 | Feeser et al. | 339/177 E |

FOREIGN PATENT DOCUMENTS

| | | | |
|---|---|---|---|
| 528,037 | 4/1954 | Belgium | 339/218 R |
| 1,300,249 | 6/1962 | France | 339/177 R |
| 588,110 | 5/1947 | United Kingdom | 339/177 R |
| 900,393 | 7/1962 | United Kingdom | 339/177 E |

*Primary Examiner*—Neil Abrams

*Attorney, Agent, or Firm*—Gust, Irish, Jeffers & Rickert

[57] ABSTRACT

A coaxial cable connector device and a coaxial cable embodying the connector device and a method of making a coaxial cable device in which a coaxial cable is provided with conductive elements which electrically engage respective ones of the conductors of the cable at each end thereof. Plastic material is molded in situ on the ends of the cable and fix the conductive elements in place on the ends of the cable and in electrical isolation with one another. At least one element on one end of a cable is complementary in configuration to an element on the other end of a cable while further conductive means is provided which is operable to effect electrical connection between the others of the elements on the respective ends of the cables. The cables can be connected in series or between a source and a receiver utilizing one and the same connector elements on the cable ends.

6 Claims, 7 Drawing Figures

COAXIAL CABLE CONNECTOR DEVICE AND METHOD OF MANUFACTURE THEREOF

BACKGROUND OF THE INVENTION

1. Field of the Invention

The present invention relates to an arrangement for connecting coaxial cables and to coaxial cables embodying such a connection and to a method of making the cables.

2. Description of the Prior Art

Coaxial cables are widely used in circumstances where isolation of circuitry from extraneous influences is desired and in respect of the conveying of high frequency signals. Examples where coaxial cables are employed are in the conveying of television signals, for example, and in citizens band radio installations and the like.

It is in connection with the forming of connector devices on the ends of such coaxial cables for connecting the coaxial cables with one another or with a receiver that the present invention is concerned. Heretofore, connector devices for connecting coaxial cables to one another or to a receiver have been rather complex, elaborate and quite expensive. Furthermore, particular care had to be taken to construct such devices to insure electrical continuity.

The present invention is particularly concerned with the provision of a connector device and a method of making a coaxial cable with the connector device and to a coaxial cable embodying connector devices in which the manufacture of the cable is relatively inexpensive while, nevertheless, the electrical characteristics of the cable remain unimpaired.

An object of the present invention is the provision of an effective but relatively inexpensive coaxial cable having connector elements on the opposite ends for connecting to another cable or to a receiver.

Another object is a method of making combination coaxial cables and connectors in an inexpensive manner.

A still further object is the provision of a connecting arrangement for effecting connection between coaxial cables or between a coaxial cable and a receiver, which is inexpensive and convenient to use and which maintains the desired electrical characteristics of the coaxial cable.

SUMMARY OF THE INVENTION

According to the present invention, a substantially conventional coaxial cable arrangement is provided having a center wire, a tubular layer of insulation of substantial thickness encircling the center wire, a tubular conductor in the form of braided wire circling the layer and, advantageously, a layer of electrical insulation surrounding the braided outer conductor.

Such basic cables, as mentioned, are widely used in connection with high frequency circuitry and to isolate circuitry from external influences.

According to the present invention, special electrically conductive connector devices are provided for the ends of the cable which are mounted on the cable in electrical engagement with the conductors making up the cable and secured in fixed position on the cable by plastic material molded in place on the cable and in engagement with the aforementioned conductive elements so as to lock the conductive elements fixedly in place on the ends of the cable.

Advantageously, the elements on opposite ends of the cable include male and female elements so that cables can be connected in series while maintaining electrical continuity between the conductors of the cables. On one end of the cable, for example, there is a ferrule fitted over the insulating layer which surrounds the central wire and abutting the end of the outer braided conductor.

An elongated resilient sleeve is crimped on the center wire of the cable and molding material is then molded in situ on the cable and in surrounding relation to the resilient sleeve while leaving the outer surface of the ferrule exposed. This end of the cable is adapted for being received in a tubular connector element which has threads on the free end thereof.

The opposite end of the cable, or the end of another cable to be connected with the first mentioned connector, has a rodlike element which receives the crimped end of the center wire in a bore in one end while a cylindrical part is fitted over the sleeve of insulation which surrounds the center wire and in abutment with the braided outer wire. Molding material is then formed in situ on the cable and locks the conductive elements in place on the cable and in predetermined positions relative to each other and electrically insulated from one another.

It has been found unnecessary to apply solder to electrical connections but, rather, by placing the conductive elements of the connectors in intimate electrical engagement with the conductors of the coaxial cable prior to the described molding operation, it has been found that electrical continuity is permanently established between the coaxial cable conductors and the conductive elements mounted on the ends thereof.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
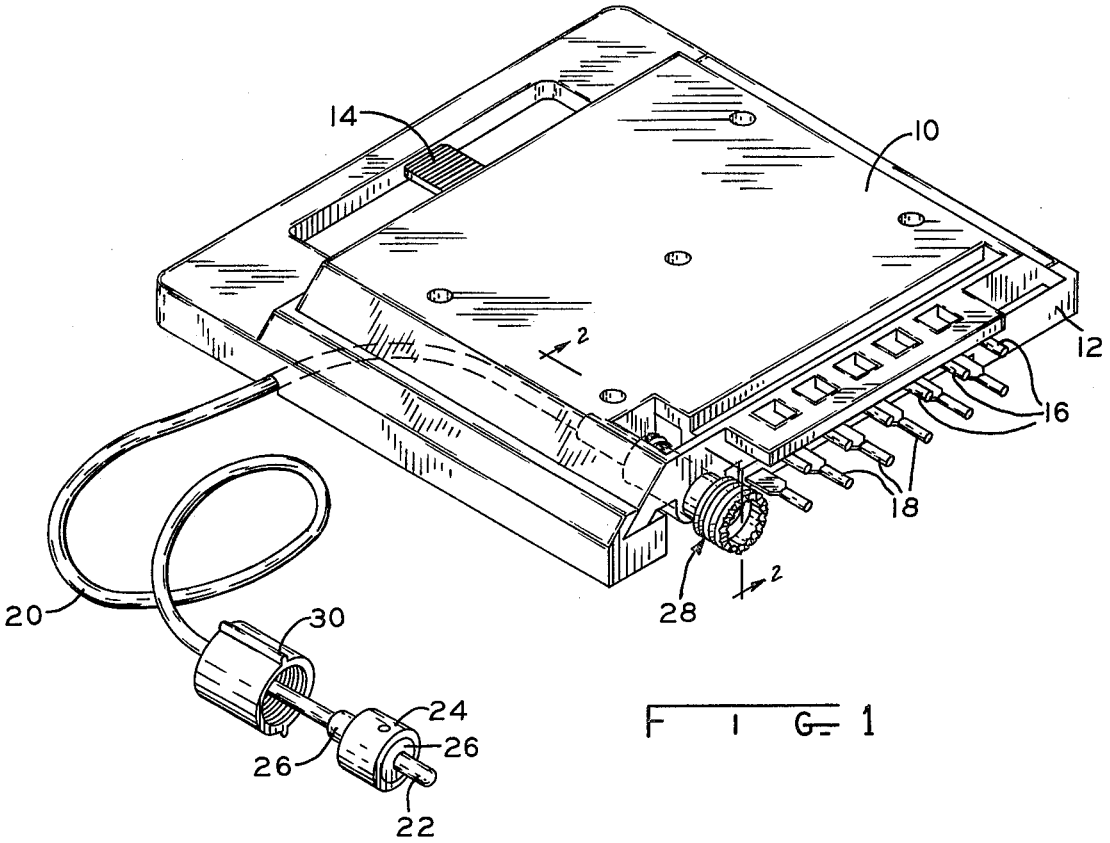
FIG. 1 is a perspective view showing equipment in which the cable device according to the present invention is adapted for incorporation.

Referring to the drawings somewhat more in detail, FIG. 1 shows somewhat schematically a separable support arrangement, commonly referred to as a slide mount, such as might be employed, for example, for detachably supporting a radio in an automotive vehicle. In the arrangement of FIG. 1, a first member 10 of the slide mount is provided which, in cross section, is somewhat dovetail in configuration and is adapted slidably to receive a second member 12 of the slide mount to be latched thereto by latch means, not shown, but which latch means is operable into unlatching position by a finger lever 14.

The member 10 is arranged for being permanently mounted by means of threaded fasteners in a vehicle, for example, under the dash or in some other convenient location, and has terminals generally indicated at 16 for connection to speakers, power supply, antenna and the like which are permanently mounted in the vehicle.

The member 12 has similar terminals at 18, and when the members 10 and 12 are assembled, as shown, each terminal 16 is in operative electrical engagement with a corresponding one of terminals 18.

The member 12 is molded of suitable plastic and is constructed to be secured to a portion of a radio or the like in conventional manner and the connectors 18 are connected to suitable terminals therein. The radio per se is not shown.

The particular slide mount 10, 12 described above is illustrated in detail in copending application Ser. No. 717,620, filed Aug. 26, 1976, and entitled "Vehicle Radio Mount", Ralph C. Burgin, inventor.

The present invention is particularly concerned with a coaxial cable 20 for an antenna circuit and with connection devices that are mounted on the ends of cable 20, the impedance characteristic of the connection devices perferably being substantially the same as that of cable 20.

The cable illustrated in FIG. 1 may lead to a suitable receiver antenna terminal in the radio secured to slide mount member 12 and on the free end comprises a conductive plug 22 which is in electrical engagement with the core wire of coaxial cable 20 and another conductive member 24 which is in electrical engagement with the outer conductor or braid of coaxial cable 20. Plastic material indicated at 26 in FIG. 1 fixes members 22 and 24 in place on the cable and in electrical engagement with the respective conductors of the cable and also holds conductive members 22 and 24 electrically insulated relative to one another.

The cable 20 is mounted on member 12 and has a connector device thereon which is complementary to the connector device 22, 24, 26 described above. This second connector device cooperates with a fitting 28 carried by member 12 which is externally threaded at 82 for receiving a nut on the end of another cable like plastic tubular nut 30 which surrounds cable 20 and slides over conductive member 24 on the end of the cable to abut the rearward end of the member 24 while exposing internal threads axially outwardly from member 24 for engagement with threads on fitting 28.

Figure 2:
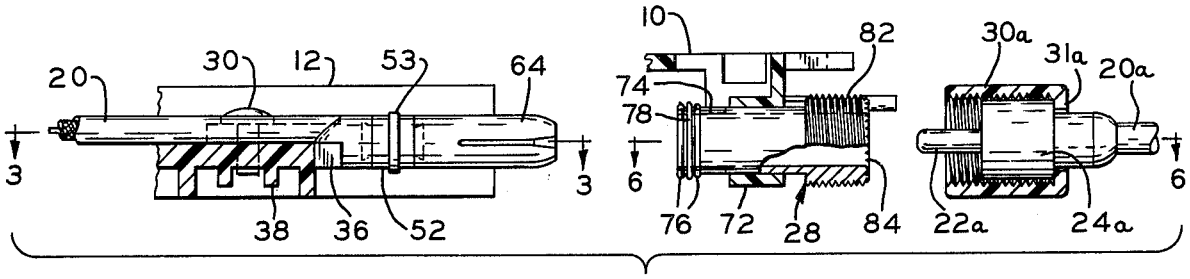
FIG. 2 is a sectional view taken along section line 2—2 showing the connector device more in detail.

FIG. 2 shows in detail the above referred to construction. With respect to the end of cable 20 which extends into member 12, the cable end is secured to member 12 by a screw 31 passing through a plastic flange 32 on cable 20 so as to be permanently a part of the assembly of member 12.

Figure 3:
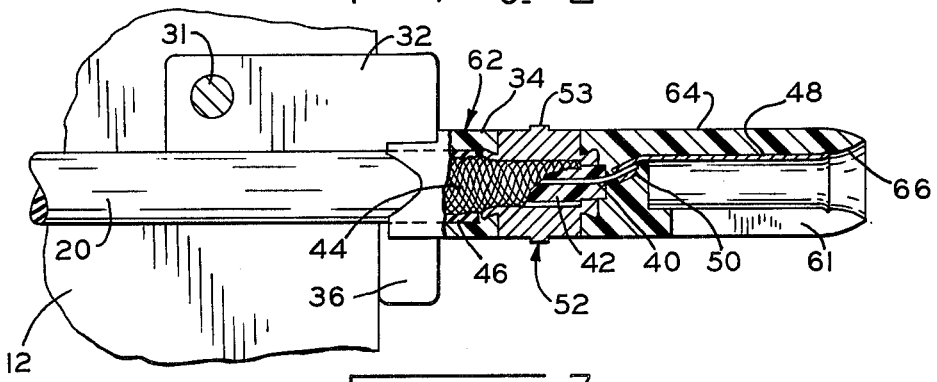
FIG. 3 is a sectional view showing more in detail one part of the connector device taken substantially along section line 3—3 on FIG. 2.

As will be seen in FIG. 3, screw 31 extends through a flange 32 integrally formed as a part of plastic body 34 molded in situ on the end of cable 20. The molded body 34 includes a laterally extending bar portion 36 which is located in engagement with the edge of the nut portion 38 on member 12 into which screw 31 is threaded. By the described arrangement, the cable 20 is fixedly located and oriented in member 12 so that when member 12 is assembled with member 10 the thus secured end of the coaxial cable is properly positioned to cooperate with a female connector of which fitting 28 carried by member 10 forms a part.

As will be seen in FIG. 3, the coaxial cable has a center wire 40 which is surrounded by tubular insulation 42 which, in turn, is surrounded by an outer conductor 44 which may be in the form of wire braid. The braid 44 is then advantageously covered by rubber-like insulation 46.

Figure 5:
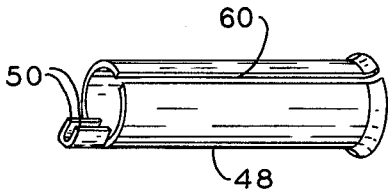
FIG. 5 is a perspective view showing another element of the connector of FIGS. 2 and 3.

In making up the connector of FIG. 3, a portion of the length of tubular insulation 42 is cut off to expose a predetermined length of conductor 40. An axially split, resilient, tubular fitting or socket element 48 of brass, shown in perspective in FIG. 5, has tab portions 50 thereon which are crimped around core wire 40 as shown in FIG. 3 thereby fixedly to connect resilient socket element 48 to wire 40 in electrically conductive engagement therewith.

Figure 4:
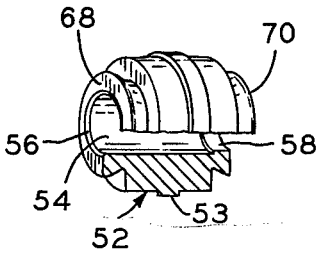
FIG. 4 is a perspective view partly broken away showing one part of the connector arrangement of FIGS. 2 and 3.

A ferrule or annular brass element 52, shown in perspective in FIG. 4, is pushed over the end portion of the wire braid 44 surrounding tubular insulating sleeve 42 thereby making electrical contact therebetween. The ferrule 52 has a central bore 54 of a diameter slidably to receive tubular insulating sleeve 42. Bore 54 is advantageously chamfered at 56 to permit the insulating sleeve 42 with braid 44 to be slidably introduced therein and is provided with a radially inwardly directed flange 58 at the other end to engage the end of the insulating sleeve 42 and braid 44, the flange 58 being radially spaced from core wire 40.

In assembling the conductive elements on the cable, the insulation 42 with braid 44 is, as mentioned before, cut off to expose the desired length of core wire 40. The ferrule 52 is then pressed on the braid 44 and sleeve 42 to the position in which it is illustrated in FIG. 3 which will cause the braid 44 to be crowded backwardly and pressed into firm electrically conductive engagement with the end of ferrule 52 as shown.

Resilient socket element 48 is then conductively secured to the end portion of core wire 40 by means of crimping and soldering tab portions 50 thereon in spaced relation to the adjacent end of ferrule 52. The thus assembled ferrule 52 and socket element 48 are inserted into the cavity of the mold (not shown) of a plastic, injection molded machine, the cavity including a locating pin (not shown) having an axially extending rib thereon which intimately fits the socket portion and axial gap 60 of element 48 and forms the slot 61 in plastic body portion 64, the slot 61 being radially coextensive with gap 60. The mold cavity is further formed with a wall contour that provides for the plastic parts 32, 34, 36 and a cylindrical portion 64 shaped as shown coaxial with but radially formed outwardly from socket element 48. At the location of ferrule 52, the mold cavity conforms to the annular ridge 53 therein. Molten plastic is then injected into the cavity and molded in situ on the end of the cable 20 and surrounds resilient socket 48 and ferrule 52 on opposite sides of ridge 53 and fixes the conductive elements 48 and 52 in place on the end of the cable 20 but electrically insulated from one another, thereby forming a cylindrical plastic body 64 fixedly about socket element 48 and the adjacent end of ferrule 52 and another body 62 formed about the other end of ferrule 52 and including the previously described parts 32, 34 and 36.

The conductive engagement of the respective elements 48, 52 with the core wire 40 and braid 44 of the coaxial cable is thereby maintained by the hardened plastic, which also serves to seal out the atmosphere and the corrosive effects thereof. The peripheral ridge 53 of the ferrule 52 is exposed between the two plastic bodies 62 and 64 so that electrical contact can be made with the ferrule 52. The end of body 64 is further molded to have a tapered opening 66 in registry with the flared open end of socket element 48 so that a connector pin may be conductively inserted completely into socket 48 from the end thereof.

It will be noted that the ferrule 52 has reduced diameter portions 68 and 70 projecting axially from opposite ends thereof with each portion 68, 70 frusto-conically shaped as shown thereby providing annular grooves so that molten plastic, during the molding operation, will fill the same and surround end portions 68, 70 thereby further locking ferrule 52 into an integrated assembly with plastic bodies 62, 64. The plastic material may be any of several known plastics which have good electrical insulating properties, and advantageously a thermal setting type so that the connector is substantially unaffected by normal ambient temperatures. The molding apparatus used is conventional in the plastics molding industry.

FIG. 2 also shows in partial cross section the tubular fitting 28 carried by member 10 and a male connector corresponding to connector 22, 30 illustrated in FIG. 1. The fitting 28, which is preferably die cast of suitable metal, is placed in the cavity of a plastics mold in which member 10 is formed and is fixed to member 10 as by a ring 72 of plastic molded around an intermediate portion of fitting 28. Fitting 28 on the end opposite the threaded portion is provided with axially extending slots 74 (see FIG. 6) and has a pair of longitudinally spaced annular ribs 76 on the outside between which there is mounted an open steel ring 78 that resiliently squeezes the several leg portions of the fitting formed by the slots 74 radially inwardly.

When members 10 and 12 are brought together in latched relation, the peripheral ridge 53 of ferrule 52 slidably fits inside fitting 28 in the region of slots 74 thereby making an intimate electrical contact therewith, the split ring 78 being flexed by this fit.

The socket body 64 is received by fitting 28 with the distal end thereof being disposed just inside the plane defined by the respective end of threaded end 82. Also some radial clearance is provided between body 64 and fitting 28 thereby permitting some radial expansion of sleeve 48 and body 64 when an oversize pin is inserted in sleeve 48. Threaded end 82 is of a size to be received within the cylindrical nut **30*a* on the cable 20*a* (like nut and cable 20 and 30 of FIG. 1**).

The nut **30*a* surrounds the metal sleeve 24*a* (like sleeve 24) and the radial end portion 84 of fitting 28 is serrated. To make a connection, pin 22*a* (like pin 22) is frictionally inserted into socket element 48 to a point at which nut 30*a* can be threaded onto end 82 of fitting 28. When fully threaded, nut 30*a* by reason of the inturned flange 31*a* engaging the back side of sleeve 24*a*, forcefully engages the other side of sleeve 24*a* with the serrated end 84 providing conductive contact therebetween. Thus, the braid 44 of the cable 20*a* is conductively connected to braid 44 of cable 20 via the contacts between sleeve 24*a* and fitting 28, ferrule 52 and braid 44 (of cable 20). Core wire 40 in cable 20*a* is connected to core wire 40 of cable 20 via the pin 22*a* and socket element 48**.

Figure 6:
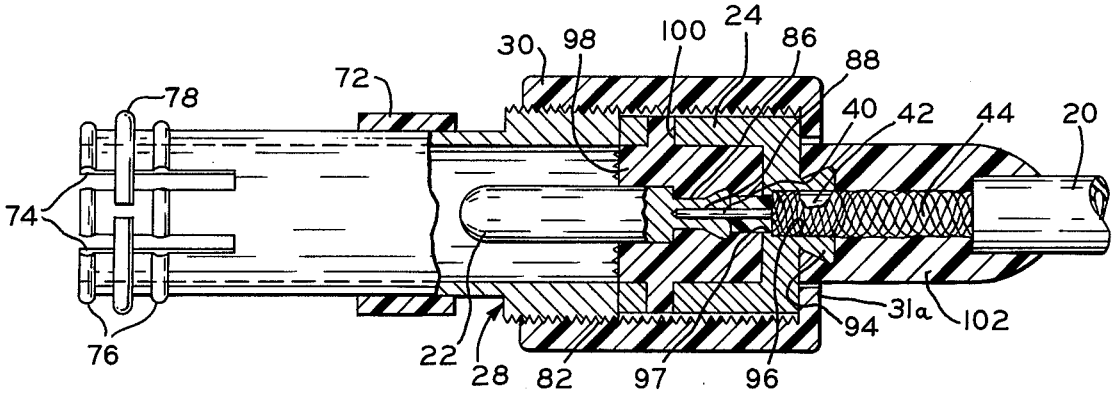
FIG. 6 is a plan sectional view taken substantially along section line 6—6 on FIG. 2 drawn at enlarged scale and showing another portion of the connector device of the present invention.
Figure 7:
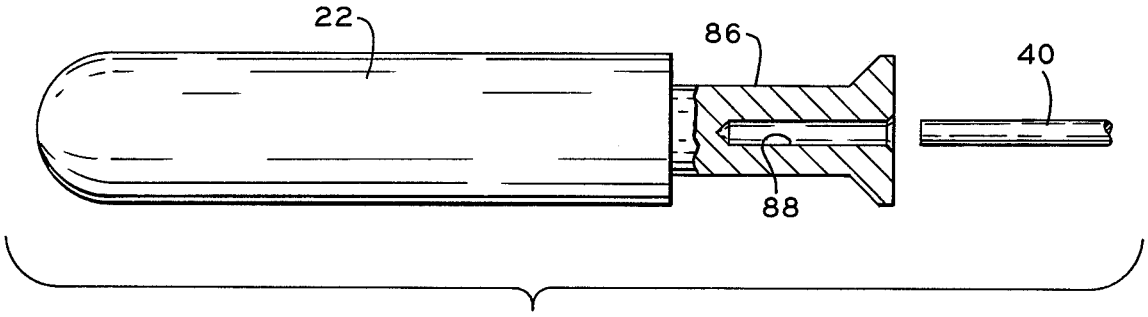
FIG. 7 is a fragmentary sectional view showing a feature in connection with the connector device of FIG. 6.

The male connector assembly 22, 24, 30 and **22*a*, 24*a*, 30*a* is shown in greater detail in FIGS. 6 and 7**.

In FIG. 6, it will be noted that conductive element 22, more specifically a cylindrical brass rod or pin with a rounded end, has a reduced diameter end portion 86, flanged on the end, with a central bore 88 into which the end of core wire 40, perferably solid copper, of the cable is inserted. Preferably the end portion 86 is crimped onto the wire 40 by a swaging operation to provide a conductive connection between wire 40 and pin 22.

As shown in FIG. 6, the sleeve **24, 24*a* is a cup-like cylinder having a frusto-conical end portion 94 extending from the bottom wall with a coaxial bore 96 therethrough which receives the tubular insulating sleeve 42 and braid 44 thereon. The end of braid 44 engages an annular shoulder 97 on sleeve 24 extending radially inwardly into bore 96 at the opposite end from end portion 94**.

When braid 44 abuts shoulder 97, the radial inner bottom surface of the cup portion of sleeve 24 lies in a plane displaced axially a short distance from the adjacent end of pin 22. In assembling the male connector, the end of the cable 20 is stripped to bare an end of wire 40 and insulator 42. Nut **30, 30*a* is telescoped over cable 20, 20*a* and the stripped end is inserted through bore 86 of sleeve 24 until braid 44 engages shoulder 97 and insulator 42 engages the end of pin 22. Bare wire end 40 is inserted into bore 88 of pin 22. End portion 86 is crimped onto wire 40 to provide a conductive connection therewith. Braid 44 is fitted into bore 96 in conductive engagement therewith and jammed or crowded into electrical contact with portion 94 of sleeve 24. Thus assembled, the assembly is placed in the cavity of an injection molding machine, with the nut 30, 30*a* outside the mold. The cavity conforms to the outer periphery of sleeve 24, is closed off along a plane surface defined by the open end (left as viewed in FIG. 6) of the sleeve 24, and is further shaped against the back side (right as viewed in FIG. 6) to encircle portion 94 and to provide the cylindrical coaxial portion of plastic about cable 20 as indicated by numeral 102. Suitable sprues in the mold and openings 100 in the wall of sleeve 24 serve to inject molten thermal setting, or if perferred, thermoplastic, plastic material into the cavity thereby to fill the cup portion 98 of sleeve 24 and to form the cylindrical portion 102 about cable 20 and the portion 94 of sleeve 24. Also the molten plastic flows into and fills lateral holes 100 in the side wall of the sleeve element 24**.

Upon hardening, the plastic fills the cavity in sleeve 24 rigidly securing pin 22 and the exposed part of wire 40 firmly in place. Also, the plastic material forms a body portion 102 surrounding cable 20 and engaging the rearward side of sleeve element 24 and surrounding and interlocking with the portion 94. Body portion 102 is smaller in diameter than element 24 so that flange **31*a* on the end of nut 30 can engage, the rearward end of element 24 while the threads engage the end of fitting 28. The nut 30, 30*a* is free to telescope over sleeve element 24**.

Minimal soldering is employed so that the elements to be conductively connected in assembly can be assembled expeditiously and with facility. It will further be evident that the parts making up the connector device according to the present invention are relatively inexpensive and the device can, therefore, be made at relatively low cost.

The fabrication of the male and female parts of the connector of this invention is primarily a plastic-molding operation wherein the plastic not only adheres the metallic parts in assembly but also to the outer insulating cover of the coaxial cable. Thus, a firm, secure assembly is provided in which the connector parts are for all effects and purposes made an integral part of the cable with substantially the same characteristic impedance. Furthermore, the injection molding technique performed at the usual high pressures of 40,000 psi, for example, force the metal braid 44 into intimate conductive contact with the ferrule 52 and sleeve 24 and the wire 40 into intimate conductive contact with a side of pin bore 88. For this reason, it is comprehended as another embodiment of this invention to merely insert loosely wire end 40 into pin bore 88, intimate conductive contact of the wire with the bore wall being assured by the side pressure of molten and hardened plastic which penetrates bore 88 without crimping the end portion 86. Thus, conductive contact within the assembly is assured as well as sealing from corrosive atmosphere by reason of the essential parts being encapsulated in plastic.

The parts 24 and 28, while preferably of die-cast metal, may be fabricated of other suitable conductive materials. The parts 48 and 52 are preferably of brass but also may be made of other suitable metal. The coaxial connector while disclosed in connection with a slide mount 10, 12 may, of course, be used in other environments or simply as a two part, coaxial connector assembly.

In the following are given typical dimensions of a working embodiment of this invention, it being understood that these are given by way of exemplary and are not to be considered as limitative.

| | |
|---|---|
| Length of pin 22 | .562 inch |
| Diameter of pin 22 | .156 inch |
| Diameter of portion 86 | .094 inch |
| Length of portion 86 | .125 inch |
| Bore 88 diameter | .035 inch to .125 inch deep |
| Sleeve 24 outer diameter | .562 inch |
| Sleeve 24 inner diameter | .375 inch |
| Sleeve 24 length | .500 + portion 94 |
| Portion 94 length | .062 inch |
| Portion 94 largest diameter | .218 inch |
| Bore 96 diameter | .152 inch |
| Shoulder diameter | .120 inch |
| Cable 20 type | RG58U |
| Ferrule 52 length overall | .437 inch |
| Frusto-conical portions 68, 70 length | .062 inch |
| Diameter of ridge 53 | .375 inch |
| Diameter of body of ferrule 52 | .343 inch |
| Diameter of bore 54 | .152 inch |
| Chamfer 56 | .187 inch |
| Diameter, outer, of portions 68, 70 | .281 inch |
| Angle of portions 68, 70 | 20° with axis |
| Length overall of socket element 48 | .750 inch |
| Length of tabs 50 | .026 inch |
| Height of tabs 50 | .090 inch |
| Width between tabs 50 | .050 inch |
| Inner diameter of element 48 | .150 inch |
| Material of element 48 | .010 inch wall thickness, brass |
| Slot 60 width | .040 inch |
| Overall length of fitting 28 | 1.250 inch |
| Outer diameter of threaded end 82 | .615 inch |
| Inner diameter of fitting 28 | .375 at mouth |
| Lengths of slots 74 | .350 inch |
| Wall thickness of unthreaded portion of fitting 28 | .032 inch |
| Length of unthreaded portion of fitting 28 | .875 inch |
| Length of socket body 64 | .960 inch |
| Outer diameter of socket body 64 | .346 inch at connection to 52 |
| Outer diameter of plastic body 12 | .375 inch |
| Length of plastic bocy 102 | .410 inch |
| Outer diameter of nut 30 | .780 inch |
| Length of nut 30 | .860 inch |
| Plastic-type | Modified Polyphenylene Oxide |

The particular use illustrated for the connector device is, of course, not the only use to which it can be put, and it will be understood that all such other uses are contemplated within the purview of this application.

While there have described above the principles of this invention in connection with specific apparatus, it is to be clearly understood that this description is made only by way of example and not as a limitation to the scope of the invention.

What is claimed is:

1. In a coaxial cable having a center conductor, an insulating sleeve surrounding the center conductor, and a tubular conductor surrounding the sleeve; connector means on at least one end of the cable comprising different conductive elements electrically engaging the center conductor and the tubular conductor and moldable plastic electrical insulating material in the form of body means molded in situ on the end of said cable and in engagement with said conductive elements thereon for fixing said conductive elements in place and in engagement with said center and tubular conductors, said insulating material holding said conductive elements in spaced electrically insulated relation on the end of the cable; said conductive elements include a socket-like first element electrically engaging the center conductor, a second element having an aperture to receive the insulating sleeve, and when mounted on the sleeve electrically engaging the tubular conductor, said body means of plastic material closely surrounding the cable on both sides of said second element and engaging both of said first and second elements to fix said elements on the cable and to support the elements in spaced electrically insulated relation, said second element having reduced diameter portions extending therefrom from both ends, each said portion being imbedded in and interlocked with said body means of plastic insulating material.

2. In a coaxial cable having a center conductor, an insulating sleeve surrounding the center conductor, and a tubular conductor surrounding the sleeve; connector means on at least one end of the cable comprising different conductive elements electrically engaging the center conductor and the tubular conductor and moldable plastic electrical insulating material in the form of body means molded in situ on the end of said cable and in engagement with said conductive elements thereon for fixing said conductive elements in place and in engagement with said center and tubular conductors, said insulating material holding said conductive elements in spaced electrically insulated relation on the end of the cable; said conductive elements include a first element in the form of an axially split sleeve having attachment means at one end for conductive engagement with the center conductor of the cable and a second element in the form of a generally cylindrical ferrule having a central hole to receive the insulating sleeve and tubular conductor of the cable, a reduced diameter annularly grooved portion on each side of said second element and each imbedded in said body means of plastic material, said body means of plastic material including a portion extending along said first element in surrounding relation thereto and also axially split, said body means of plastic material exposing a conductive region of said second element for electrical engagement by a conductor.

3. A coaxial cable according to claim 2, in which the center conductor of the cable is a wire, said attachment means comprising bendable tabs on one end for being connected to the center conductor.

4. A coaxial cable according to claim 2 in which said region of said second element is an annular portion which is larger in diameter than said body means of plastic material.

5. In a coaxial cable having a center conductor, an insulating sleeve surrounding the center conductor, and a tubular conductor surrounding the sleeve; connector means on at least one end of the cable comprising different conductive elements electrically engaging the center conductor and the tubular conductor and moldable plastic electrical insulating material in the form of body means molded in situ on the end of said cable and in engagement with said conductive elements thereon for fixing said conductive elements in place and in engagement with said center and tubular conductors, said insulating material holding said conductive elements in spaced electrically insulated relation on the end of the cable; one of said conductive elements having an aperture to receive said insulating sleeve and said tubular conductor, said aperture providing an area of electrical contact with said tubular conductor;

said conductive elements include a pin-like first element electrically engaging the center conductor, a second element having opposite sides and an aperture to receive the insulating sleeve and tubular conductor, and when mounted on the sleeve electrically engaging the tubular conductor, said body means of plastic material closely surrounding the cable and abutting both sides of said second element and engaging both of said first and second elements to fix said elements on the cable and to support the elements in spaced electrically insulated relation.

6. A coaxial cable according to claim 5 which includes a nut slidably telescoped on the cable and having a threaded peripheral wall to surround and extend axially beyond one side of said second element and a radial flange at the end of said peripheral wall to engage the other side of said second element.

* * * * *